US009022779B2

(12) United States Patent
Polidoro

(10) Patent No.: US 9,022,779 B2
(45) Date of Patent: May 5, 2015

(54) MULTI-GAS BURNER HEAD WITH SUCKED OR BLOWN AIR

(76) Inventor: Aldo Polidoro, Schio (IT)

( * ) Notice: Subject to any disclaimer, the term of this patent is extended or adjusted under 35 U.S.C. 154(b) by 627 days.

(21) Appl. No.: 13/321,912

(22) PCT Filed: Apr. 20, 2010

(86) PCT No.: PCT/EP2010/002400

§ 371 (c)(1),
(2), (4) Date: Nov. 22, 2011

(87) PCT Pub. No.: WO2010/130325

PCT Pub. Date: Nov. 18, 2010

(65) Prior Publication Data

US 2012/0115097 A1 May 10, 2012

(30) Foreign Application Priority Data

May 13, 2009 (IT) ..... VI2009A0114

(51) Int. Cl.
*F23D 11/00* (2006.01)
*F23D 14/58* (2006.01)

(52) U.S. Cl.
CPC ..... *F23D 14/586* (2013.01); *F23D 2203/1026* (2013.01); *F23D 2203/108* (2013.01)

(58) Field of Classification Search
CPC ..... F23D 14/22; F23D 14/32; F23D 14/586; F23D 2203/108; F23D 2203/1026; F23D 2213/00; F23D 14/04; F23D 14/10; F23D 2203/106; F23D 14/36; Y02E 20/344; F23C 6/047; F23C 9/00; F23C 99/00; F23M 5/025
USPC ..... 431/159, 8, 10, 181, 9, 354
See application file for complete search history.

(56) References Cited

U.S. PATENT DOCUMENTS

2003/0148241 A1 * 8/2003 Shimazu et al. ..... 431/354

FOREIGN PATENT DOCUMENTS

| | | | | |
|---|---|---|---|---|
| EP | 0524387 | A2 | 1/1993 | |
| FR | 502980 | A | 5/1920 | |
| FR | 2300965 | A1 * | 10/1976 | ..... F23D 14/08 |
| FR | 2300965 | A1 | 9/1978 | |
| GB | 1059431 | A | 2/1967 | |

(Continued)

OTHER PUBLICATIONS

International Search Report in PCT/EP2010/002400 dated Jun. 23, 2010.

(Continued)

*Primary Examiner* — Kenneth Rinehart
*Assistant Examiner* — Bao D Nguyen
(74) *Attorney, Agent, or Firm* — Bucknam & Archer

(57) ABSTRACT

The finding concerns a multi-gas burner head with sucked or blown air, from which the mixture of fuel gas and comburent air comes out and the combustion occurs. Such a head is made from a metallic sheet in which there is at least one row of aligned slits (2), substantially rectangular-shaped; such a sheet is folded so as to have a series of flat flaps (3) in succession, each of the slits being arranged so as to be closed like a "sandwich" between two flat portions of the sheet, once the flaps of the structure are mutually compressed. The gas mixture is intended to pass from the bottom (5) of the flaps and then through the slits and finally to come out at two side by side crests (6) of the structure where the combustion occurs.

1 Claim, 6 Drawing Sheets

(56) References Cited

FOREIGN PATENT DOCUMENTS

| | | | |
|---|---|---|---|
| GB | 1220596 | A | 1/1971 |
| IT | VI2007A000063 | | 3/2007 |

OTHER PUBLICATIONS

Written Opinion of the International Search Authority in PCT/EP2010/002400 dated Jun. 23, 2010.

* cited by examiner

MULTI-GAS BURNER HEAD WITH SUCKED OR BLOWN AIR

CROSS REFERENCE TO RELATED APPLICATIONS

This application is the National Stage of PCT/EP2010/002400 filed on Apr. 20, 2010, which claims priority under 35 U.S.C. §119 of Italian Application No. VI2009A000114 filed on May 13, 2009, the disclosure of which is incorporated by reference. The international application under PCT article 21(2) was published in English.

The present finding concerns a multi-gas burner head with sucked or blown air, according to the general part of claim 1.

It is known that many types of burners with sucked or blown air have a head made from a thin metallic sheet, in which there are one or more rows of slits and/or slits, at which the mixture of fuel gas and comburent air come out and the combustion occurs. These burners take up many various conformations and configurations depending on the particular types of use they have.

It is usually desired for such a burner to simultaneously have the following characteristics:

- great calorific power, obtained by the burner being small;
- possibility of adjusting the flame with a wide range of variations in pressure of the gas, without for this reason compromising the performance of the combustion and the maximum temperature reached by the burner head;
- possibility of passing from one fuel gas to another without any modification as far as the mechanical part of the burner is concerned, but adjusting only the passage of gas from the nozzle that introduces the aforementioned gas inside the burner. As far as this last characteristic is concerned, it is known that the gas grid distributor sometimes uses methane gas of various types, which can have more or less calories, or coal gas, propane, or other fuel gases. Moreover, sometimes, for availability issues, said gases can be more or less mixed together. In the case in which a burner with blown air is used, a special automatic device provides for varying the quantity of air coming from the supply ventilation system.

Vice versa, in the case in which a burner with sucked air is used, it will be the burner itself that, also in this case automatically, will provide for varying the quantity of air sucked by the Venturi tube positioned upstream of the burner, so as to be adapted to the type of fuel gas.

In principle, there are not great operation difficulties for the burner if the flame is not adjusted; in other words, it is not problematic to design a burner correctly, operating either at full power or idle (on-off).

The problems begin when the burner is made to operate with very low power, since, in such a case, the temperature of the outer surface of the burner can reach temperatures greater than 1000° C., thus compromising the correct operation of the burner itself.

The fact that there is this high temperature leads to, as the most dangerous drawback, the possibility of so-called back-firing, or more precisely the ignition of the mixture inside the mixing chamber, occurring. Indeed, when the head heats at such temperatures, the mixture of comburent air and fuel gas inside the mixing chamber comes into contact with the head and tends to ignite and to continue burning inside said chamber. This can lead to the destruction of the burner, as well as the formation of a substantial amount of CO in the combustion fumes.

In order to prevent this type of disadvantageous disaster, numerous provisions have been conceived able to reduce the temperature of the surface of the head of the burner which comes into contact with the air/gas mixture. As an example the following provisions have been foreseen:

- burner head made from ceramic material of the porous type or, in any case, having various types of slits. In this way the temperature of the inner part of the head is reduced and there is no combustion inside the mixing chamber.
- presence of a cooled head through contact with a circuit where a cooling fluid, in particular water, is circulated;
- head made through metallic wires made from a fabric with warp and woof; this structure heats on the outside, but poorly transmits the heat to the underlying part of the head, which is indeed that which comes into contact with the gas mixture.

In reality, many other provisions have been conceived able to avoid the high temperatures of the burner head, but all have proven to be very complicated and expensive to make.

It is clear that, from the principle point of view, the simplest provision to carry out would be that of making a head having a substantial outlet surface, as well as a great thickness and having a small amount of material in contact with the flame, all in order for the heat to develop on the outer surface and to be dispersed so that the temperature of its inner surface is as low as possible.

Unfortunately, these types of heads are particularly onerous and difficult to make.

In order to avoid these drawbacks a multi-gas burner head with sucked or blown air has been conceived, which was the object of the patent application for the industrial invention number V12007A000063, of the same applicant of the present application, in which it is foreseen for its head to be made from a metallic sheet folded in a corrugated manner and with slits present on the crests of said corrugations.

The purpose of the present finding is that of making a multi-gas burner head which is able to obtain even better results in all possible calorific operating conditions, with respect to such a burner head, as well as to all other heads present in the state of the art.

This is achieved, according to the finding, by foreseeing that the burner head be made from a metallic sheet in which there is at least one row of substantially rectangular-shaped aligned slits; such a sheet is folded so as to have a series of flat flaps which follow after one another and each of the slits is arranged so as to be closed like a "sandwich", between two flat portions of the sheet. Once the flaps of the structure are pressed together, the gas mixture is intended to pass from the bottom of the flaps, then, through said slits and finally to come out at the crests of the structure in which the combustion occurs.

These and other characteristics of the finding shall be described in detail hereafter, with reference to some of its particular embodiments given as an example and not for limiting purposes, with the help of the attached drawing tables, in which.

Figure 1:
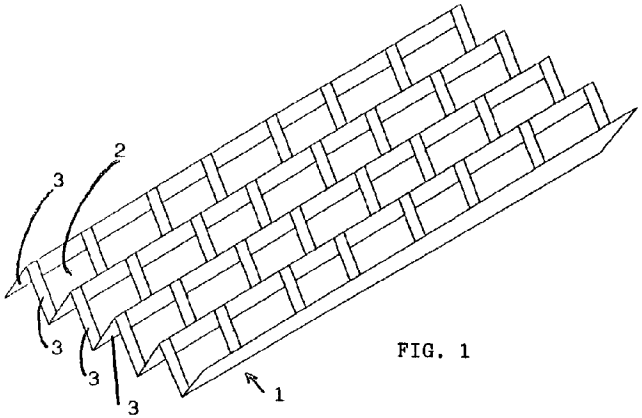
FIG. 1 (table 1) illustrates an axonometric view in a first embodiment of the burner head according to the finding, in which the various flaps are still completely pressed together.
Figure 2:
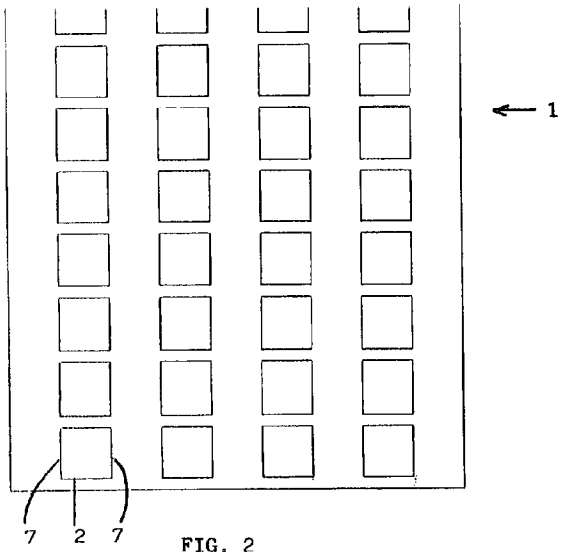
FIG. 2 illustrates a plan view of the sheet still arranged flat.
Figure 3:
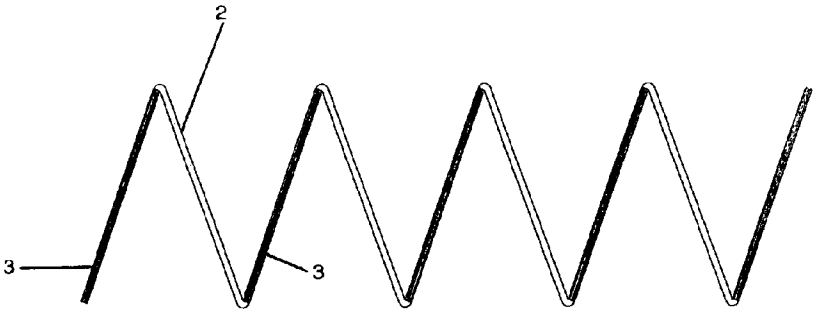
FIG. 3 illustrates a schematic side view of the structure according to FIG. 1.

In FIGS. 1 and 2 it can be seen that the burner according to the finding has a head which is made from a sheet 1, made from metallic material, preferably in heat resistant stainless steel. As an indication this sheet shall have a thickness of about 0.4-2 mm. On this sheet there is at least one row of aligned slits 2 with an essentially rectangular shape; in the figures there are four rows of aligned slits. The sheet is folded so as to have a series of flat flaps 3 in succession. The flaps are foreseen so that each of the slits 2 is arranged so as to be closed like a "sandwich" between two full portions of the sheet.

Figure 16:
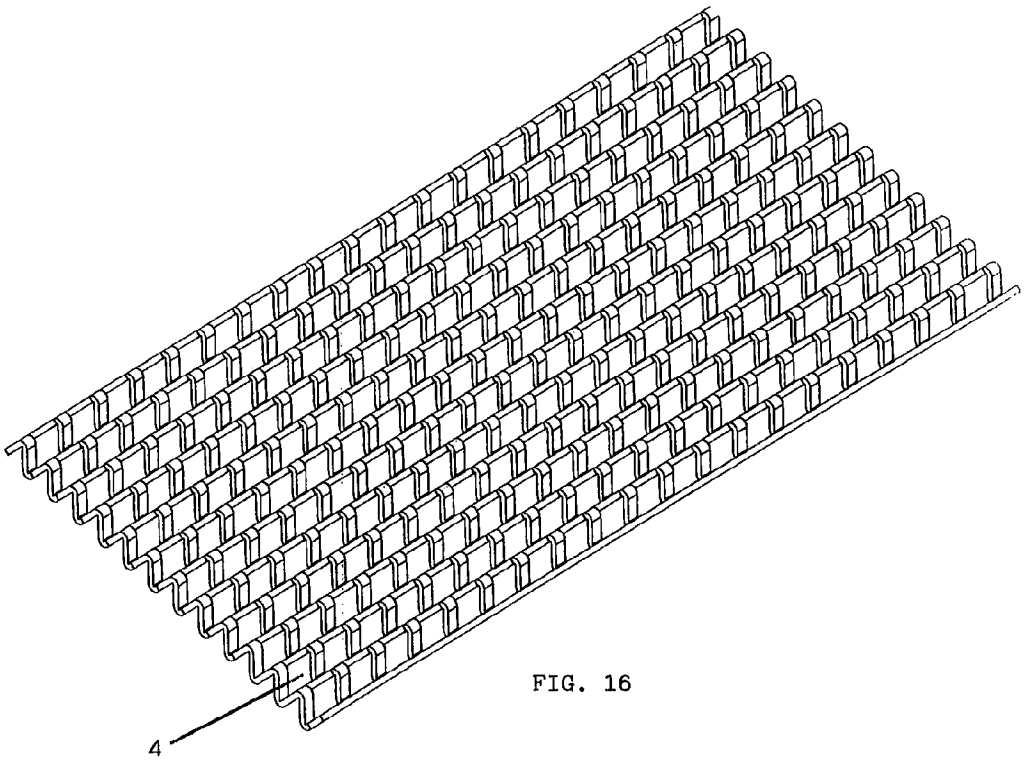
FIGS. 16, 17 (table IV) illustrate, an axonometric view in the burner head according to the finding, with the various flaps not yet pressed and an enlarged detail of the aforementioned head, respectively.
Figure 17:
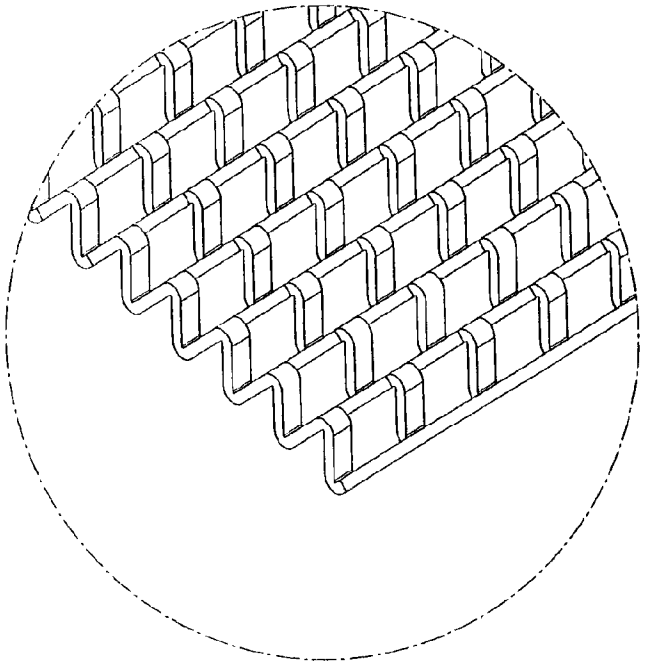
Figure 18:
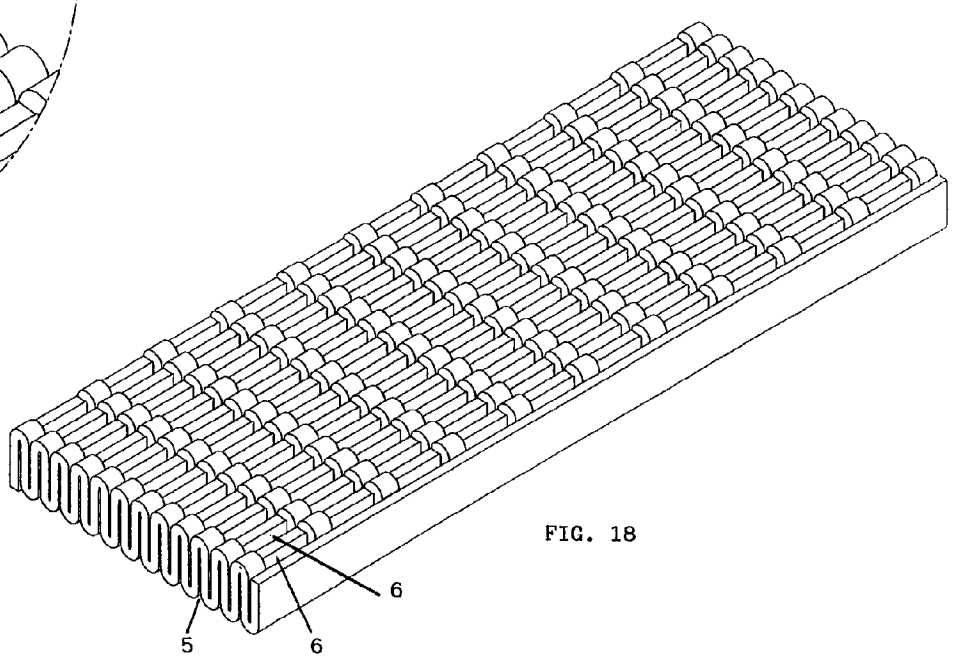
FIGS. 18, 19 illustrate figures which are analogous to those of the previous table, with the flaps present in the head of the burner which have been pressed together.
Figure 19:
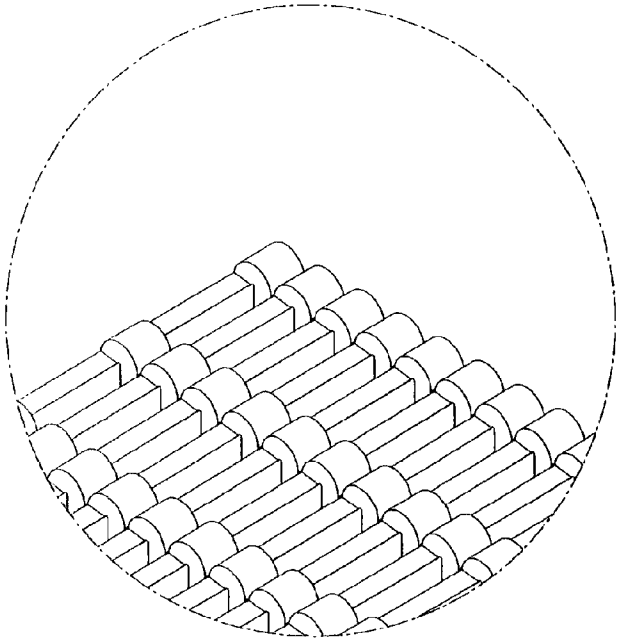

The structure of this burner head is clearly illustrated in FIGS. 16, 17, in which it is possible to see the sheet in which the various valleys are not yet pressed together and in FIGS. 18 and 19, where they are.

Figure 4:
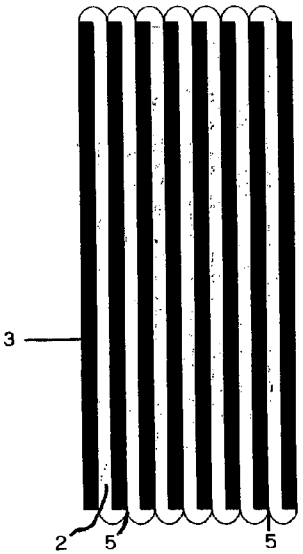
FIG. 4 illustrates a side view of the burner head after being pressed.
Figure 5:
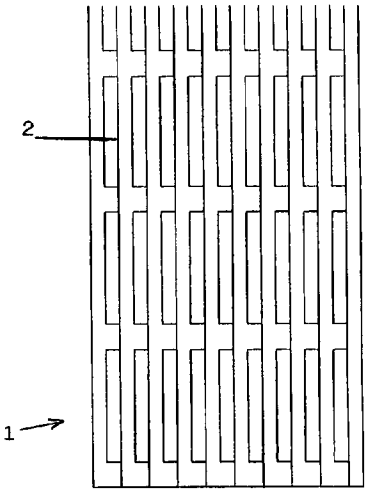
FIG. 5 illustrates a top schematic view, but from a slightly lateral position, of said head in pressed conditions.

The gas mixture of comburent air and fuel gas is intended to pass from the bottom 5 of the flaps (see FIGS. 4 and 18) and then through the slits 2, and subsequently it comes outside at two side by side crests 6 of the structure, where the combustion occurs.

In the simplest configuration of the head according to the finding, illustrated in FIGS. 1 and 2, the various successive flaps foresee a "full portion", following an "empty portion". In practice the folds of the sheet correspond to the top and bottom of the various flaps and are carried out at the edges of the slits 2 arranged along the longitudinal extension of one of the rows of said slits.

Figure 8:
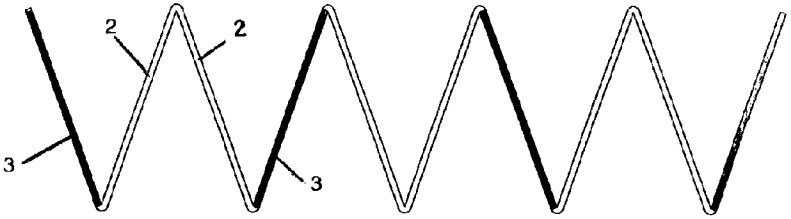
FIGS. 6 to 10 (table II) illustrate figures which are analogous to those of the previous table, relative to a second embodiment of the device according to the finding.
Figure 9:
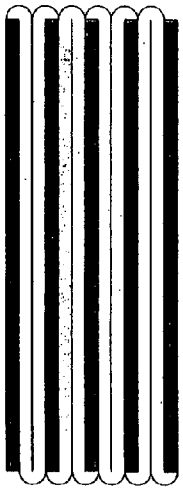
Figure 10:
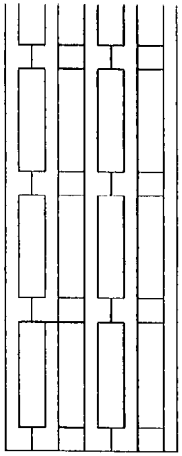
Figure 6:
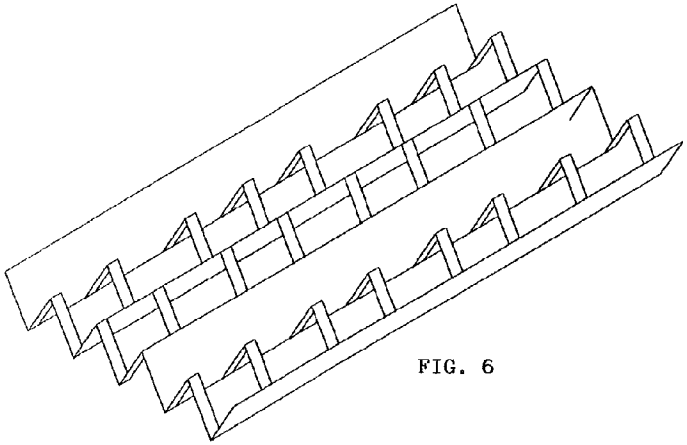
Figure 7:
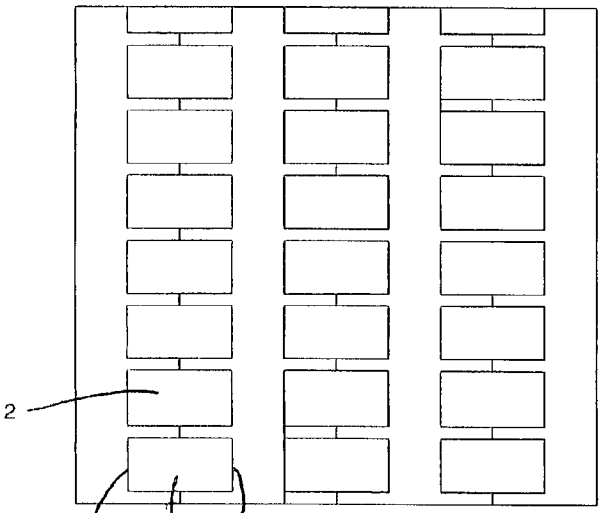
Figure 13:
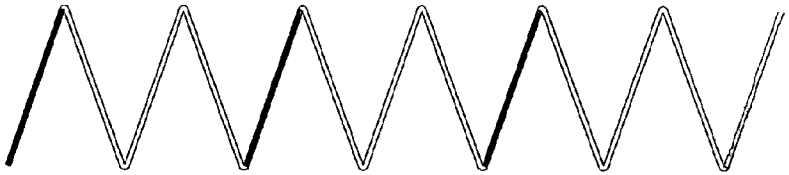
FIGS. 11 to 15 (table III) illustrate figures analogous to the previous tables relative to a third embodiment of the device according to the finding.
Figure 14:
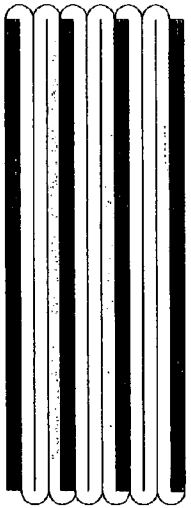
Figure 15:
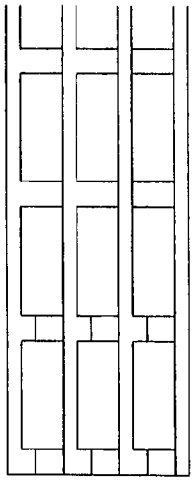

It is also possible to foresee, as illustrated in figures from 6 to 10, that the folding lines of the various folds, as well as at the edges 7, are also present at the transversal mid-line of said slits, again considering them parallel with respect to the longitudinal extension of the row of slits themselves. In this way "two empty spaces" are defined compressed between "two full spaces", as can be clearly seen in particular in FIGS. 8, 9 and 10.

Figure 11:
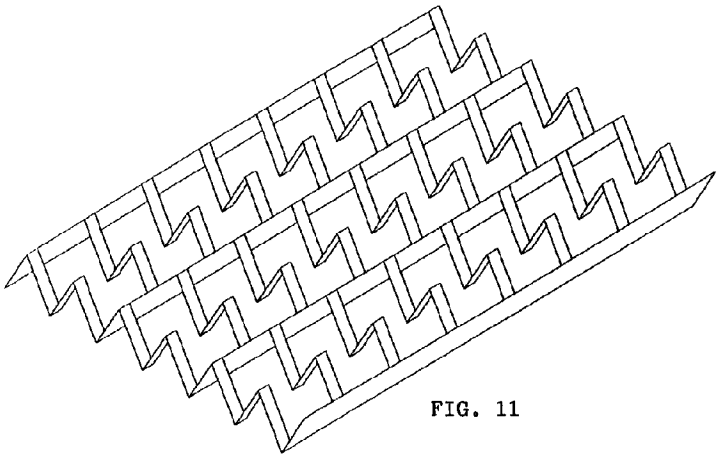
Figure 12:
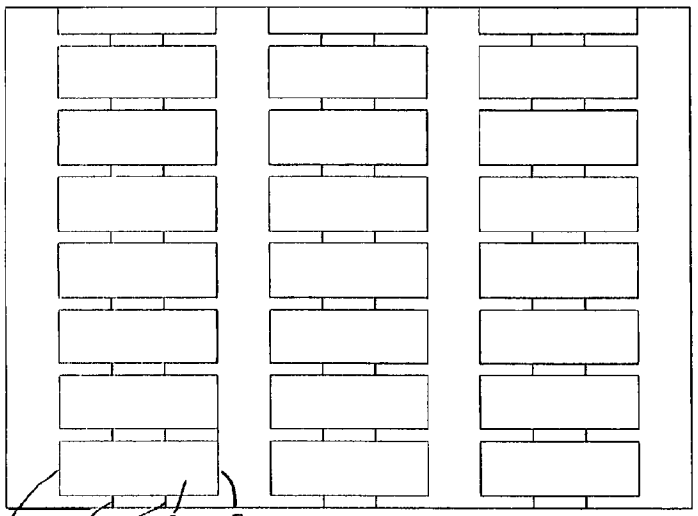

Similarly, it is possible to make sure, as illustrated in FIGS. 11 to 15, that the folds of the various flaps are made, as well as at the edges 7 of the slits 2, also at the lines 9 that ideally divide the empty spaces into equal parts. In the example of FIGS. 11 and 12 said slits are divided into three equal parts. In practice, in this embodiment, "three empty spaces" are compressed between "two full spaces".

In practice, the difference between these embodiments, from the practical point of view, consists of the thickness of the slits positioned on top of the folded sheet, at which the combustion occurs.

Figure 23:
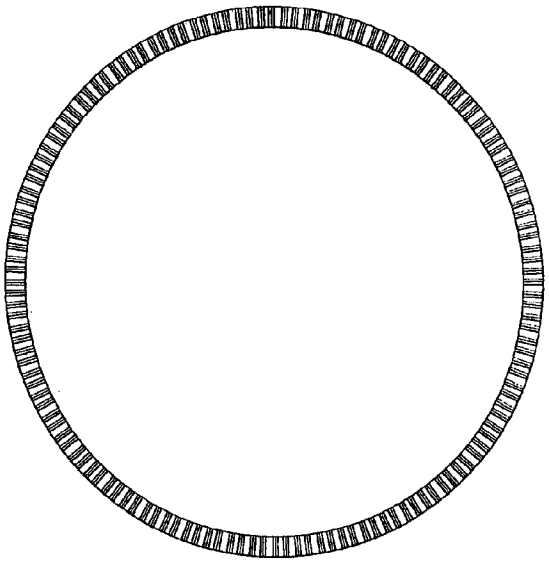
FIGS. 23 and 24 illustrate two views, lateral and plan views, respectively, of a method of use of the structure illustrated in FIG. 21.
Figure 24:
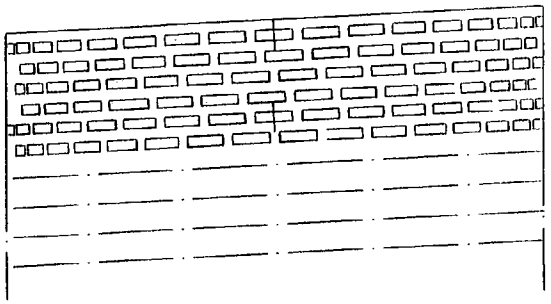
Figure 20:
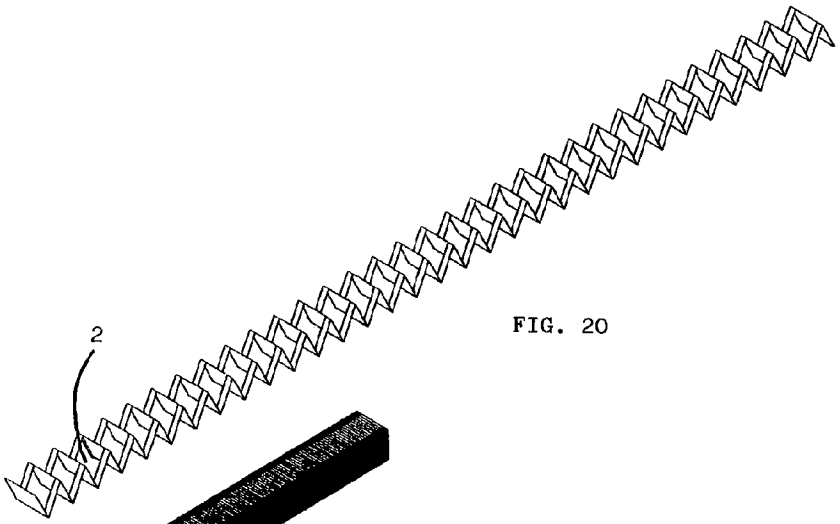
FIG. 20 (table VI) illustrates a further embodiment of the device according to the finding with the various flaps not yet pressed.
Figure 21:
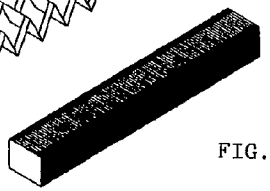
FIG. 21 illustrates what is illustrated in FIG. 20 with the flaps pressed together.
Figure 22:
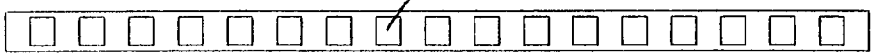
FIG. 22 represents a plan view of the sheet provided with slits before undergoing folding.

In FIG. 20 it can be seen that, according to a further embodiment of the finding, it is possible to foresee a burner head which has a single row of slits 2. In particular the compressed structure is illustrated in FIG. 21, whereas the not yet compressed structure is illustrated in FIG. 20. In particular, the structure illustrated in FIG. 21 can be arranged in coils so as to form a cylindrical spiral structure, thus obtaining the element illustrated in FIGS. 23 and 24.

Of course, even in this type of structure, in which there is a single row of slits 2, it is possible to foresee the arrangements of slits illustrated in alternative embodiments of the device according to the finding ("double", "triple" or more empty spaces between "two full spaces").

Advantageously, the burner head according to the finding, once the sheet has been folded and is thus ready to be used, shall have a thickness which can vary between 2 and 20 mm. Typically it has been found that, whereas the temperature of the surface of the head on which the combustion occurs will reach values near to 1000° C., at depths of about 5 mm the temperature will be of about 900° C. and at depths of about 10 mm said temperature will be of about 700° C.-800° C.

Therefore, with the provisions previously described, a burner head can be obtained in which the inner surface has a temperature which is substantially lower than that of the outer surface, in particular, not leading to the danger of back-firing.

It has also been possible to verify that burners using the head according to the finding are able to operate in any operation conditions, in particular with particularly low power, since it is not, indeed, intrinsically subject to back-firing.

The invention claimed is:

1. A multi-gas burner head with sucked or blown air from which a mixture of fuel gas and comburent air exits and combustion occurs, comprising:

a metallic sheet folded with an accordian fold forming a folded structure defined by a series of adjacent flat flaps (3) in succession each defining at a first side a bottom (5) and at a second side opposing the first side defining a crest (6) of the folded structure; and at least one row of rectangularly shaped aligned apertures (2) formed in said metallic sheet, each aperture (2) extending from the bottom (5) of a respective flat flap (3) to the crest (6) of the folded structure, said at least one row of apertures (2) being arranged in said metallic sheet whereby when folded to form said folded structure each aperture (2) is sandwiched between adjacent flat flaps (3) so that the gas mixture is adapted to pass from the bottom (5) then through the aperture (2) of each respective flat flap (3) to exit at side by side crests (6) of the folded structure where combustion occurs.

* * * * *